US007123222B2

(12) United States Patent
Borel et al.

(10) Patent No.: US 7,123,222 B2
(45) Date of Patent: Oct. 17, 2006

(54) METHOD OF IMPROVING THE LUMINOUS EFFICIENCY OF A SEQUENTIAL-COLOR MATRIX DISPLAY

(75) Inventors: Thierry Borel, Chantepie (FR); Didier Doyen, La Bouexiere (FR)

(73) Assignee: Thomson Licensing, Boulogne-Billancourt (FR)

( * ) Notice: Subject to any disclaimer, the term of this patent is extended or adjusted under 35 U.S.C. 154(b) by 105 days.

(21) Appl. No.: 10/496,812

(22) PCT Filed: Nov. 19, 2002

(86) PCT No.: PCT/EP02/12941

§ 371 (c)(1),
(2), (4) Date: Dec. 10, 2004

(87) PCT Pub. No.: WO03/046879

PCT Pub. Date: Jun. 5, 2003

(65) Prior Publication Data

US 2005/0088462 A1 Apr. 28, 2005

(30) Foreign Application Priority Data

Nov. 29, 2001 (FR) ..... 01 15425

(51) Int. Cl.
*G09G 3/36* (2006.01)

(52) U.S. Cl. ..... 345/88; 345/691

(58) Field of Classification Search ..... 345/88, 345/98, 690, 691; 348/742
See application file for complete search history.

(56) References Cited

U.S. PATENT DOCUMENTS

| | | | | |
|---|---|---|---|---|
| 4,907,862 | A | 3/1990 | Suntola | 350/345 |
| 5,461,397 | A | 10/1995 | Zhang et al. | 345/102 |
| 5,767,828 | A | 6/1998 | McKnight | 345/89 |
| 5,977,942 | A * | 11/1999 | Walker et al. | 345/97 |
| 6,151,004 | A * | 11/2000 | Kaneko | 345/88 |
| 6,573,951 | B1 * | 6/2003 | Hewlett et al. | 348/770 |

* cited by examiner

*Primary Examiner*—Jimmy H. Nguyen
(74) *Attorney, Agent, or Firm*—Joseph J. Laks; Harvey D. Fried; Christine Johnson

(57) ABSTRACT

The present invention relates to a method of improving the luminous efficiency of a sequential-colour matrix display, the display being driven using an addressing method of the pulse width modulation (PWM) type. This method comprises, for each pixel of a subframe, the following steps: comparison of the pixel colour value of the preceding subframe with a reference value so as to provide an overlap value depending on the period of overlap with the current subframe; if the pixel color value of the current subframe less the overlap value gives a positive value, a time offset is added to the pixel color value of the current subframe; if the pixel color value of the current subframe less the overlap value gives negative value, the pixel color value of the current subframe is forced to be zero. The invention applies to LCOS or LCD displays.

8 Claims, 7 Drawing Sheets

METHOD OF IMPROVING THE LUMINOUS EFFICIENCY OF A SEQUENTIAL-COLOR MATRIX DISPLAY

This application claims the benefit, under 35 U.S.C. § 365 of International Application PCT/EP02/12941 filed Nov. 19, 2002, which was published in accordance with PCT Article 21(2) on Jun. 5, 2003 in English and which claims the benefit of French patent application No. 0115425, filed Nov. 29, 2001.

FIELD OF THE INVENTION

The present invention relates to a method of improving the luminous efficiency of a sequential-colour matrix display. It relates especially to matrix displays in which the electrooptic valve consists of a liquid-crystal valve, more particularly a valve of the LCOS (Liquid Crystal On Silicon) type.

Liquid-crystal display (LCD) panels used in direct viewing displays or in projection displays are based on a matrix scheme with an active element at each pixel. Various addressing methods are used to generate the grey levels corresponding to the luminance to be displayed at the selected pixel. The most conventional method is an analogue method whereby the active element is switched for a line period in order to transfer the analogue value of the video signal to the capacitor of the pixel. In this case, the liquid crystal material is oriented in a direction that depends on the value of the voltage stored on the capacitor of the pixel. The incoming light polarization is then modified, and analysed by a polarizer so as to create the grey levels. One of the problems with this method stems from the response time of the liquid crystal, which depends on the grey levels to be generated. Thus, when this method is used to drive the electrooptic valve of a sequential-colour matrix display in which the electrooptic valve, especially the LCOS valve, is successively illuminated with red, green and blue colour filters, the very short response time between the intermediate grey levels results in very poor saturation of the colours in the image when one colour is not completely eliminated during illumination by the next colour.

To remedy this type of drawback, there has been proposed in the prior art, for example in the patent U.S. Pat. No. 6,239,780, a method of driving a matrix display using a pulse width modulation or PWM technique. In this case, the pixels of the liquid-crystal display are addressed in on/off mode, the "on" mode corresponding to saturation of the liquid crystal. The grey levels are given by the width of the pulse. With such an addressing method, the dynamics of the display panel are improved since the transition time now represents only a small proportion of the total opening time of the liquid-crystal cell, whatever the value of the luminance.

This addressing method is particularly beneficial when it is used with a sequential-colour optical engine using a single electrooptic valve, more particularly a LCOS valve, which is illuminated in succession with the colours red, green and blue. This method, since an on/off mode is used, benefits from a more rapid response time, this being constant whatever the grey level that has to be rendered.

However, although this method has the advantage of improving the response time of the liquid crystal and thus of obtaining optimum colour saturation for the video content, nevertheless the luminous efficiency decreases proportionally with the response time of the liquid crystal.

The object of the present invention is therefore to provide a method for improving this efficiency in the case of a sequential-colour matrix display, in which the display is driven using an addressing method of the pulse width modulation or PWM type.

Consequently, the subject of the present invention is a method of improving the luminous efficiency of a sequential-colour matrix display, the display being driven using an addressing method of the pulse width modulation or PWM type, characterized, for each pixel of a subframe, by the following steps:

- comparison of the pixel colour value of the preceding subframe with a reference value so as to provide an overlap value depending on the period of overlap with the current subframe;
- if the pixel colour value of the current subframe less the overlap value gives a positive value, a time offset is to be added to the pixel colour value of the current subframe;
- if the pixel colour value of the current subframe less the overlap value gives a negative value, the pixel colour value of the current subframe is forced to be zero.

According to another feature of the present invention if the pixel colour value of the current subframe less the overlap value gives a negative value, the pixel colour value of the preceding subframe and the colour value of the next subframe are modified so as to maintain the original tint, while at the same time reducing the luminance.

In accordance with the present invention, the steps described above apply in succession to each sequential colour of a frame. Moreover, the pixel colour value of a subframe depends on the width of the PWM-type addressing pulse. The reference value depends on the response time of the material forming the display and the time offset depends on the response time of the material forming the display and on the duration of the subframe.

Other features and advantages of the present invention will become apparent on reading the description given below of one embodiment of the present invention, this description being given with reference to the drawings appended hereto, in which:

FIG. 1 is a schematic representation of a matrix display driven using an addressing method of the pulse width modulation or PWM type, to which the present invention can apply;

FIGS. 2*a* to 2*e* show the various signals for driving the display of FIG. 1;

FIGS. 3*a* to 3*c* are curves giving the luminance value in the case of a display driven using a PWM-type addressing method, whereby saturation is preserved;

FIGS. 4*a* to 4*c* are figures similar to FIGS. 3*a* to 3*c* in the case in which priority is given to luminance as opposed to colour saturation;

FIGS. 5*a* to 5*c* are figures identical to FIGS. 3*a* to 3*c* and 4*a* to 4*c* giving the luminance obtained in the case of the method of the present invention;

To simplify the description in the figures, the same or similar elements will have the same references.

Figure 1:
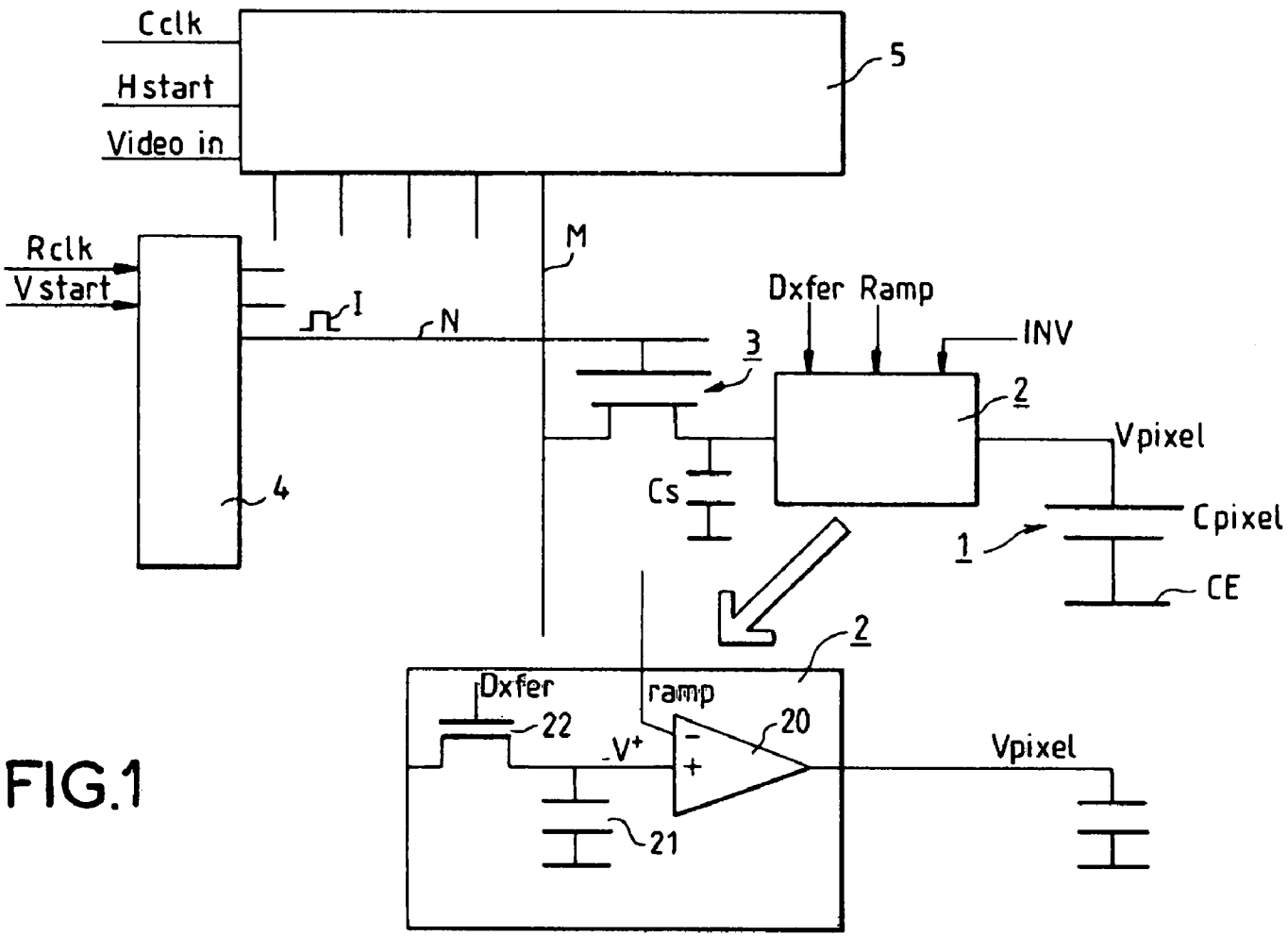

We will firstly describe, with reference to FIG. 1, an embodiment of a matrix display to which the present invention may apply. This matrix display comprises an electrooptic valve, more particularly a LCOS-type display panel. FIG. 1 shows very schematically a picture element or pixel 1 of the display panel. This pixel 1 is indicated symbolically by a capacitor Cpixel connected between the back electrode CE and, in the embodiment shown, the output of a voltage-time converter 2 for implementing an addressing method of the pulse width modulation or PWM type.

As shown schematically, the voltage-time converter 2 comprises an operational amplifier 20 whose negative input receives a ramp-shaped signal, labelled Ramp, and whose other input receives a positive voltage corresponding to the charge on a capacitor 21. The charge on the capacitor 21 is controlled by a switching system, more particularly a transistor 22 mounted between one electrode of the capacitor and the input of the voltage-time converter. This switching device consists of a transistor whose gate receives a pulse, labelled Dxfer.

As shown in FIG. 1, the picture element or pixel 1 is connected to a row N and a column M of the matrix via a switching circuit such as a transistor 3. More specifically, the gate of the transistor 3 is connected to a row N of the matrix, which is itself connected to a row driver 4. Moreover, one of the electrodes of the transistor, for example the source, is connected to the input of the voltage-time converter 2, while the other electrode or drain is connected to one of the columns M of the matrix, this column being connected to a column driver 5 which receives the video signal to be displayed. Moreover, a capacitor Cs is mounted in parallel with the pixel capacitor as input to the voltage-time converter in order to store the video signal value when the said pixel is selected. The column driver 5 and row driver 4 are conventional circuits. The column driver 5 receives the video signal to be displayed, "Video in", and is controlled by a clock signal Cclk and a start pulse Hstart. The row driver 4 allows the rows to be addressed sequentially and receives a clock signal Rclk and a start pulse Vstart.

The mode of operation of the display panel when it is used in a sequential-colour display, namely when, during a frame T, a wheel carrying three, green, blue and red, colour filters makes one complete revolution in order to illuminate the valve sequentially, will be explained with reference to FIGS. 2*a* to 2*e*.

Figure 2:
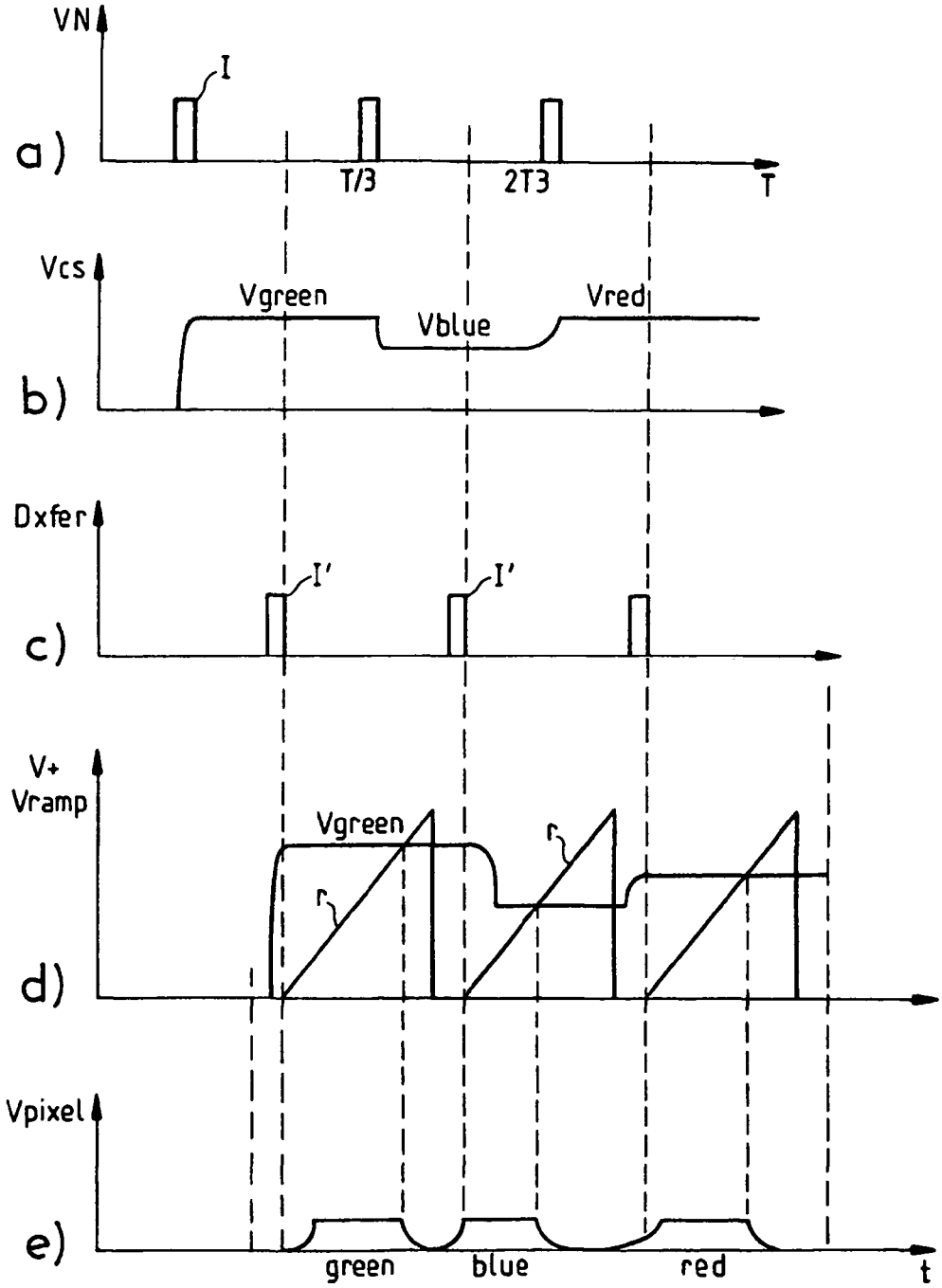

As shown in FIG. 2*a*, a pulse I is applied at the start of each subframe T/3 to the row N so as to turn on the switching transistor 3. When the switching transistor 3 is turned on, the capacitor Cs charges up to a voltage corresponding to the video signal present on the column M. That is to say, if a green colour filter lies opposite the display during the first subframe T/3, the capacitor Cs charges up to a value labelled Vgreen in FIG. 2*b*. During the next subframe, namely at time T/3, a new pulse I is applied to the row N, allowing the capacitor Cs to charge up to a voltage labelled Vblue, corresponding to the colour blue lying at that moment opposite the display. Likewise, at time 2T/3, a new pulse I is applied to the row N and the capacitor Cs charges up to a voltage labelled Vred in FIG. 2*b*. With the display in FIG. 1 driven using a PWM addressing method, the values Vgreen, Vblue, Vred stored in succession on the capacitor Cs are applied to the capacitor Cpixel via the voltage-time converter 2 which operates in the following manner.

A pulse I' is applied within a subframe to the gate Dxfer of the switching transistor 22 so as to turn it on. In this case, the voltage stored on the capacitor Cs is transferred to the capacitor 21 mounted in parallel and connected to one of the input terminals of the operational amplifier 20. As shown in FIG. 2*d*, at the end of the pulse I' applied to the gate Dxfer, a ramp r is applied to the negative input of the operational amplifier 20. In this way, a voltage Vpixel, the duration of which corresponds to the voltage Vgreen stored on the capacitor 21, is obtained as output from the operational amplifier 20, as shown in FIGS. 2*d* and 2*e*. The same applies in the case of the subframes that correspond to the passing of the blue and red colour filters in the case in which the display in FIG. 1 is used for sequential colour display.

We will now explain, with reference to FIGS. 3*a* to 3*c*, 4*a* to 4*c* and 5*a* to 5*c*, the problem that the method of the present invention seeks to solve, this being applied especially to a matrix display like that described with reference to FIG. 1.

Figure 3A:
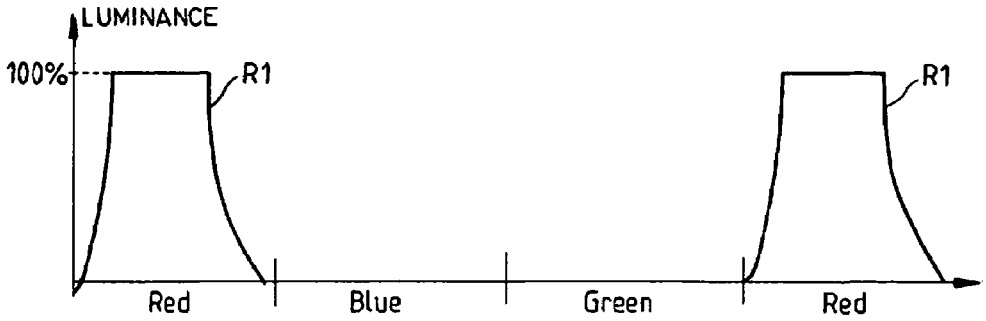
Figure 3B:
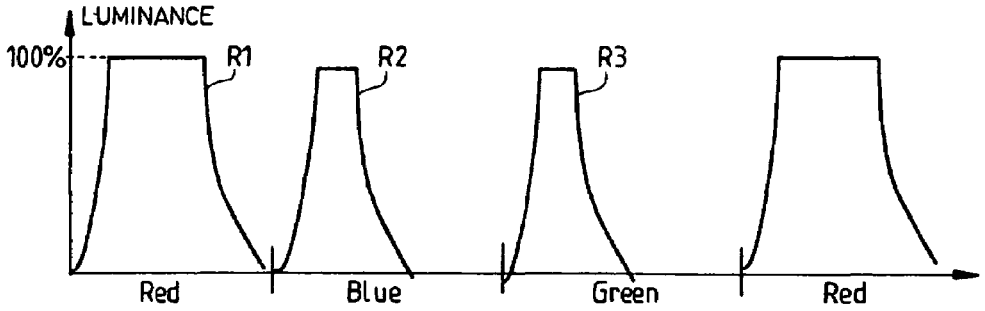
Figure 3C:
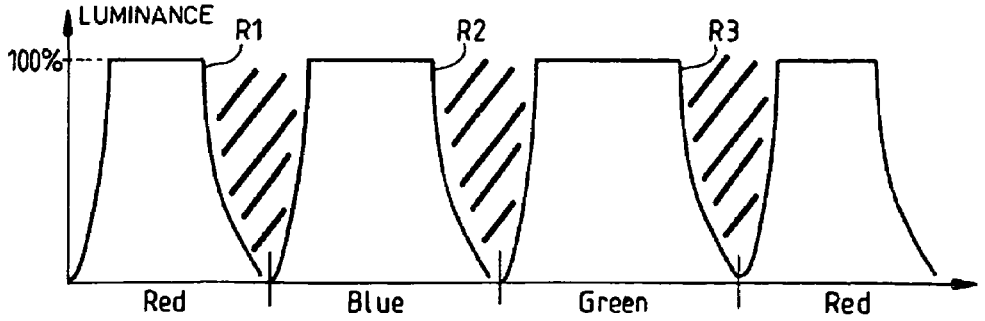
Figure 4A:
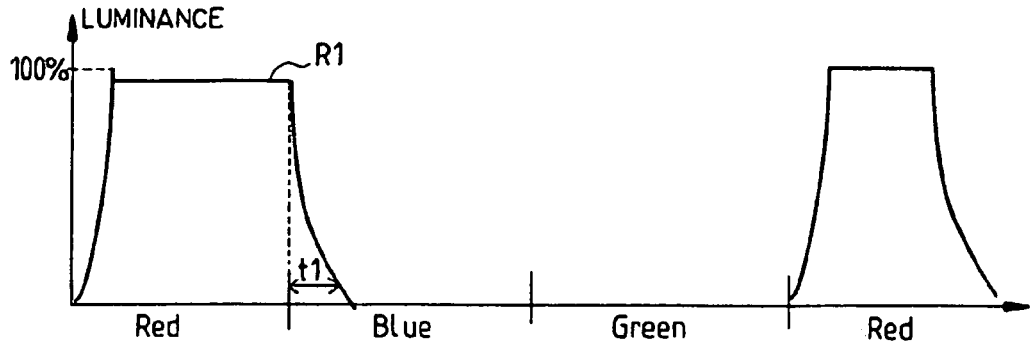
Figure 4B:
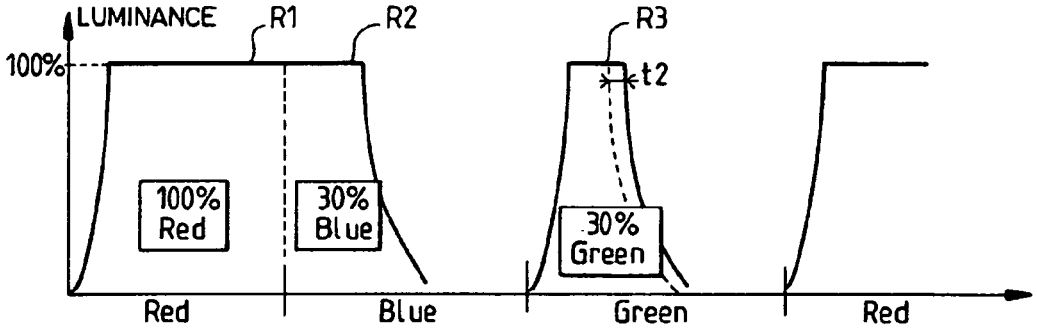
Figure 4C:
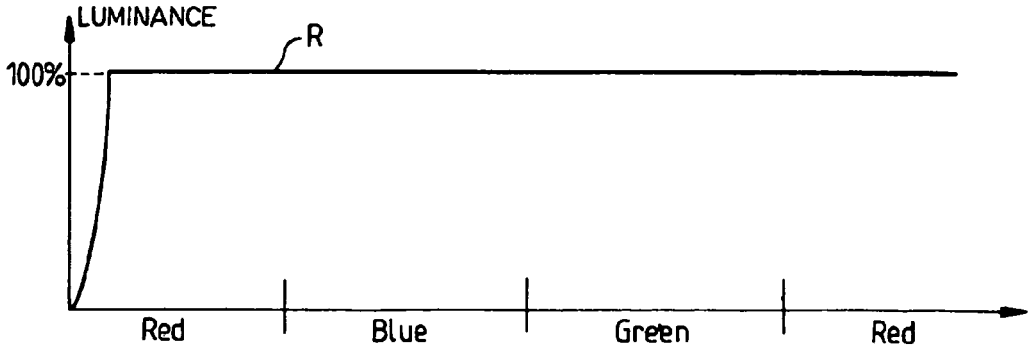

FIGS. 3*a* to 3*c* show the luminance values obtained when it is desired to have saturated colours. In this case, it may be clearly seen that the loss of luminous efficiency is due to the fact that the liquid crystal in the case of an LCOS valve requires long rise and fall times, namely of a few milliseconds. Thus, in FIG. 3*a*, which shows a 100% saturated red pixel being addressed, the subframe labelled Red receives a 100% luminance signal R1 over the duration of the subframe, whereas the subframes labelled Blue and Green receive no signal. There is no overlap between the colours and colour saturation is maintained. FIG. 3*b* shows the addressing of a pastel red pixel. In this case, the subframe Red is addressed by a pulse R1 throughout the duration of the subframe, whereas the subframes Blue and Green are addressed by pulses R2, R3 for a shorter time. In this case too, in order to maintain saturation of the colours, there is no overlap of the colours of one subframe with another. FIG. 3*c* shows the addressing of a white pixel. In this case, each subframe, Red, Blue, Green, is addressed by identical pulses R1, R2, R3 over the entire period of each subframe. Because of the pulse rise and fall times, a loss of luminous efficiency shown symbolically by the bold lines between each pulse in FIG. 3*c*, is observed. FIGS. 4*a*, 4*b* and 4*c* are figures identical to FIGS. 3*a*, 3*b* and 3*c*, but in the case in which priority is given to luminance and not to colour saturation. In the case of a 100%-saturated red pixel being addressed, as shown in FIG. 4*a*, the pulse R1 is therefore applied during the Red subframe over a period t1 greater than the time T/3, so that the pulse fall time overlaps the subframe labelled Blue. In this way, some of the blue light passes through the red, producing a pink pixel. FIG. 4*b* shows the case in which a pastel red pixel is being addressed. In the same way, the Red subframe is addressed by a 100% saturated pulse R1, with a pulse fall time starting at the end of the subframe and overlapping the Blue subframe. The Blue subframe is addressed by a 30% Blue pulse R2 and the Green subframe by a 30% Green pulse R3. Since the Green pulse does not have the same starting point, a time offset t2 must be added in order to compensate for the rise time of the liquid crystal, as shown by the solid and dotted lines in FIG. 4*b*.

FIG. 4*c* shows a white pixel being addressed. In this case, a perfect white is obtained in the case of the Red, Blue and Green subframes, as shown by the single pulse R.

The results obtained with the method used in the present invention to improve the luminous efficiency will now be described with reference to FIGS. 5*a*, 5*b* and 5*c*.

In this case, the method used consists, for each pixel of a subframe, in comparing the pixel colour value of the preceding subframe with a reference value so as to deliver an overlap value that depends on the period of overlap with the current subframe and then, if the pixel colour value of the current subframe less the overlap value gives a positive value, a time offset is to be added to the pixel colour value of the current subframe, and if the pixel colour value of the current subframe less the overlap value gives a negative value, the pixel colour value of the current subframe is forced to be zero.

Figure 5A:
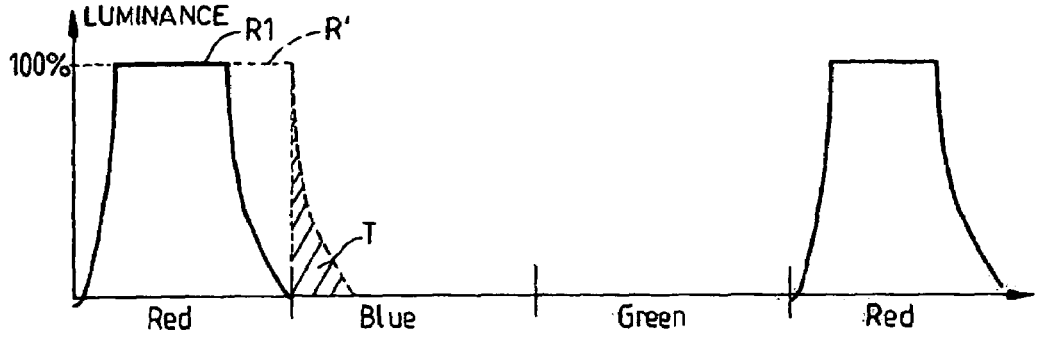
Figure 5B:
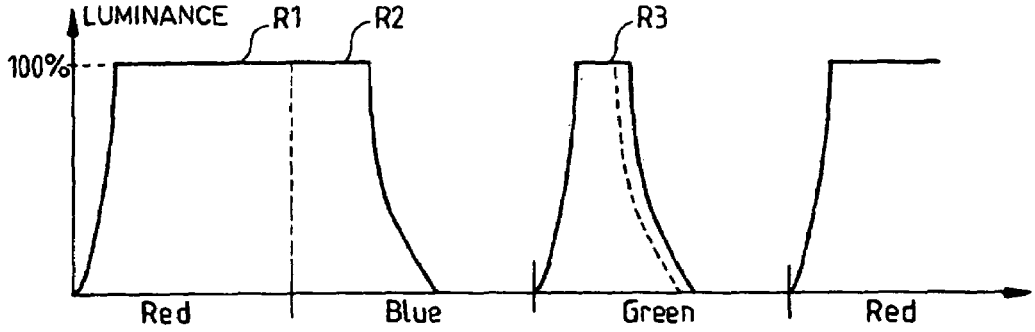

The results of this method are shown, for example, in FIG. 5*a* in which, during the subframe labelled Red, a 100% luminance signal R1 is applied and the dotted part R' shows that colour saturation is maintained when the Red subframe is addressed, while slightly reducing the luminance by an amount equivalent to the overlap time represented by the hatched part.

According to a variant of the method, if the pixel colour value of the current subframe less the overlap value gives a negative value, the pixel colour value of the preceding subframe and the colour value of the next subframe are modified so as to maintain the original tint, while at the same time reducing the luminance. This is shown, for example, in FIG. 5*b*, which gives an example of a pastel red pixel being addressed. In this case, the Red subframe is addressed by a pulse R1 which overlaps the Blue subframe addressed by a pulse R2, as in the case of FIG. 4*b*, and the Green subframe is addressed by a pulse R3. In accordance with the method, the pastel colours maintain their original luminance level.

Figure 5C:
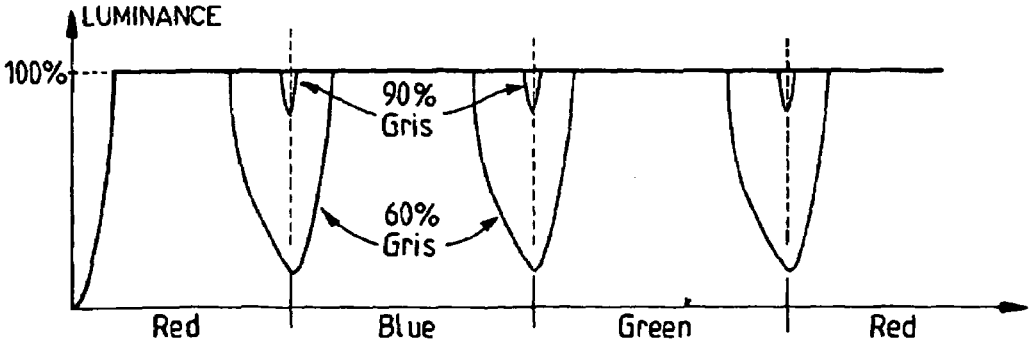

Shown in FIG. 5*c* is an example of addressing a completely white pixel or one having a 60% or 90% grey level, as shown. In this case, the pulses for the Red, Blue and Green subframes are identical and of the same duration, the duration varying depending on the desired grey level.

An example of implementation of an electronic circuit allowing the method described above to be employed will now be described with reference to FIGS. 6, 7 and 8.

Figure 6:
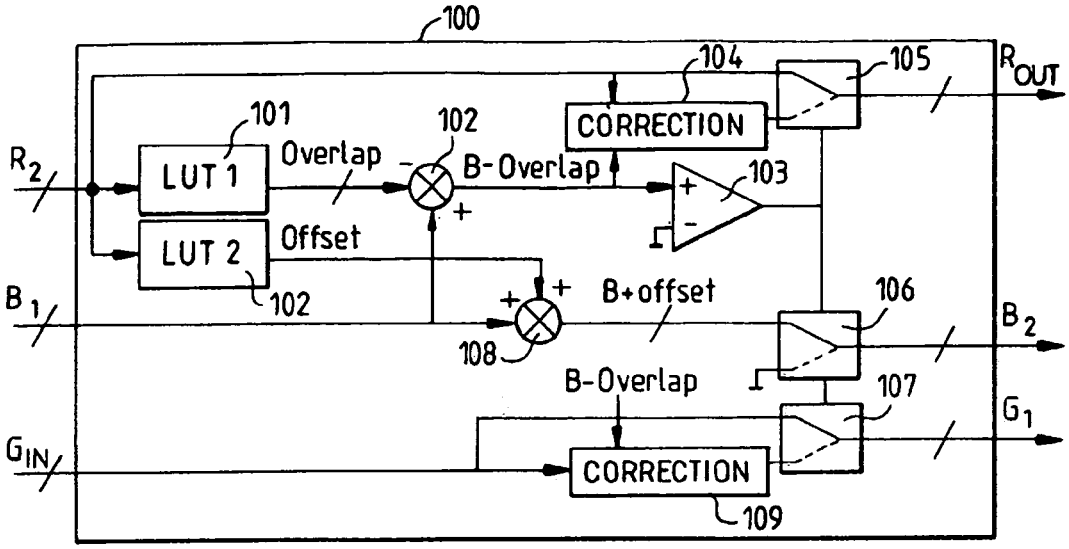
FIG. 6 is a diagram in block form of a circuit for implementing the method of the present invention.

As shown more particularly in FIG. 6, which shows a circuit 100 using the invention for the colour red, the preceding colour value, namely the value R2, is sent to a look-up table, labelled LUT1 101, which outputs an overlap datum proportional to the period of overlap with the Blue subframe. This datum is sent to the input of a circuit 102 which subtracts the overlap value from the current blue colour value B1. A B-overlap value is obtained as output from the circuit 102. This value is sent as input to a comparator 103, more particularly to the+ terminal of the comparator 103, the-terminal of which is connected to earth. The output from the comparator 103 is sent to two switching circuits 105, 106, 107 as trigger value for the switches 105, 106 and 107. Moreover, one of the inputs of the switch 105 receives the previous colour value R2, which is also sent to a circuit 104 that fulfils a correction function, which will be described below. The circuit 104 also receives the B-overlap value.

The output from the correction circuit 104 is sent to the other input terminal of the switching circuit 105, which gives as output a value $R_{OUT}$ for the red output value. The previous colour value R2 is also sent to a second look-up table LUT2 102 which gives, as output, an offset value labelled Offset. This offset value Offset is sent to one input terminal of an adder 108, the other terminal of which receives a blue colour value $B_1$, so as to give, as output, a B+Offset colour value which is sent to one of the inputs of the switching circuit 106, the other input of which is connected to earth. A blue colour value labelled $B_2$ is obtained as output from the switching circuit 106.

Moreover, a green colour signal labelled $G_{IN}$ is sent to a circuit 109 fulfilling a correction function, which receives the signal B-overlap as input. The output from the correction circuit 109 is sent to one of the inputs of a switching circuit 107, while the other input of the switching circuit 107 receives the colour value $G_{IN}$. The switching circuit 107 is controlled by the signal coming from the comparator 103 and gives a colour value signal $G_1$ as output.

Figure 7:
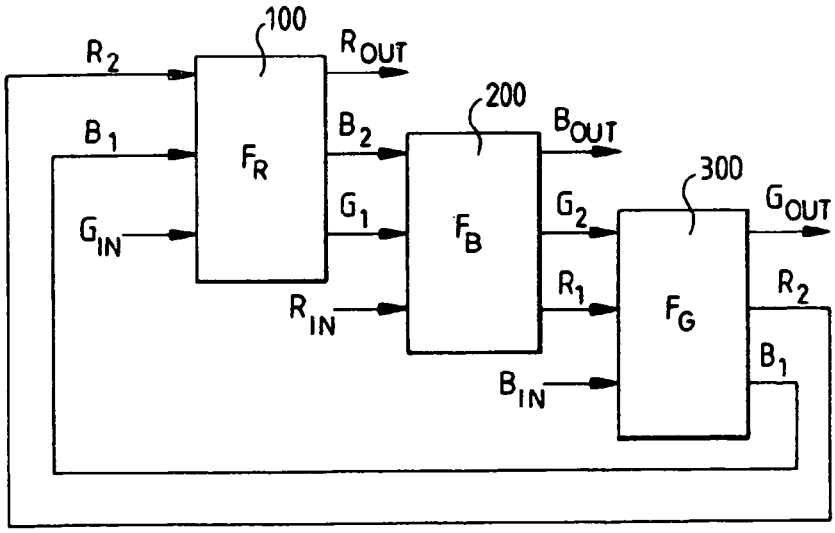
FIG. 7 is a diagram in block form showing the circuit of FIG. 6 applied to the three colours red, blue and green.
Figure 8:
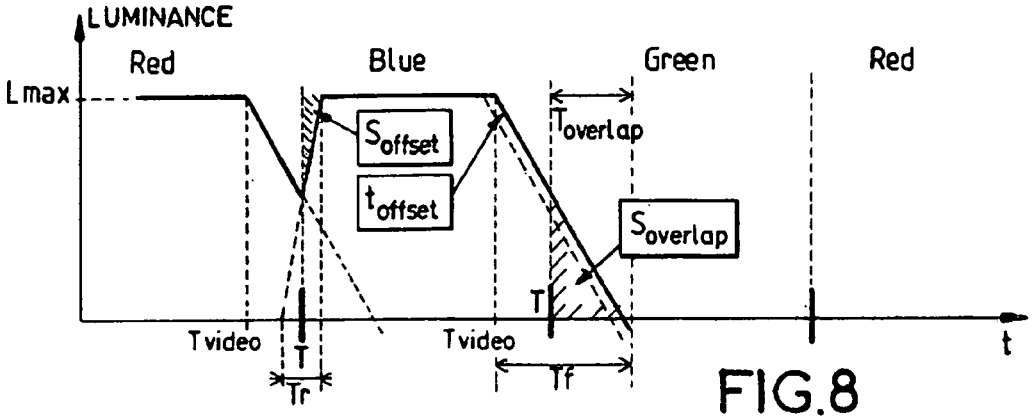
FIG. 8 is a diagram giving the luminance as a function of time, allowing the principle applied in the present invention to be explained.

FIG. 7 shows three circuits 100, 200, 300 identical to the circuit shown in FIG. 6, making it possible to carry out the method described above in succession for the colours red, $F_R$, blue, $F_B$, and green, $F_G$. As shown in FIG. 7, the output $B_2$ and the output $G_1$ coming from the circuit 100 are sent to the circuit 200 and a red colour value $R_{IN}$ is sent as input to the circuit 200. The circuit 200 makes it possible to obtain the blue colour value $B_{OUT}$. The same applies in the case of the circuit 300, which receives as input the green colour value $G_2$ and the red colour value $R_1$ output by the circuit 200 and a blue colour value $B_{IN}$ and which gives as output the green colour value $G_{OUT}$ and the red colour value $R_2$ and the blue colour value $B_1$ which are fed back into the circuit 100 carrying out the improvement function in the case of the red colour $R_{OUT}$.

The operation of the circuits in FIGS. 6 and 7 will be explained below. Thus, the red colour value $R_2$ is sent to the table LUT1 100 which includes reference values depending on the response time of the material forming the display, the content of this table being explained below.

The overlap value is subtracted from the blue colour value $B_1$ so as to give B-overlap. If this value is greater than zero, the switching element 105 outputs the colour value $R_2$ onto $R_{OUT}$ and the B+Offset value is added to the blue channel $B_2$, the switch 106 being positioned as shown in FIG. 6. The green value $G_1$ as output is also equal to the input value $G_{IN}$, the switch 107 being positioned as shown in FIG. 6. If the B-overlap value is less than zero, the switch 106 switches to the earthed input and the blue value $B_2$ is set to zero. In this case, the switches 105 and 107 switch to their input connected to the correction function circuits 104 and 109, respectively, and the values of the outputs $R_{OUT}$ and $G_1$ are reduced by an amount that maintains the original tint value, while reducing the luminance.

As will be explained below, the correction function consists of a block based on multipliers that reduce the red and green values, in the case of FIG. 6, depending on the B-Overlap value.

In the embodiment in FIG. 6, the overlap data and the offset data are obtained from two tables LUT1 101 and LUT2 102. However, these data could be calculated from one another by solving, for example, the system of two equations in two unknowns below:

$$S_{overlap}\%=f(t_{video})$$

$$S_{offset}\%=g(t_{video})$$

$$=>S_{offset}\%=g(f^{-1}(S_{overlap}\%)).$$

As explained below, the Overlap and Offset values depend on the response time of the liquid crystal material and on the duration of the subframe.

An illustration of the values contained in the table LUT1 101 will now be given with reference to FIG. 8. FIG. 8 characterizes an example of a liquid crystal LC having linear rise and fall times in order to simplify the demonstration.

The label $S_{offset}$ corresponds to a lack of luminance in the blue subframe labelled Blue, induced by the rise-time and fall-time characteristics of the liquid crystal. To correct this, it is necessary to add a time offset to the blue value. This offset is labelled $t_{offset}$. $S_{overlap}$ corresponds to the contamination of the green value with the blue value. Two cases may occur, as described above:

the pixel colour is not saturated. In this case, the blue colour is not modified, nor is the green colour;

the pixel colour must be saturated. In this case, the blue value must be reduced by a value corresponding to $S_{overlap}$=green value.

Consequently, the other two colour values must be reduced by the same value in order to maintain constant tint. This is the role of the correction functions in FIG. 6. If $S_{overlap}$ and $S_{offset}$ are calculated as a function of the video signal of the preceding subframe, $T_{video}$, the rise and fall times, Tr and Tf and the subframe period T, the calculation results in:

$$S_{overlap} = \frac{1}{2}(t_{video} + T_f - T)^2 \cdot \frac{L_{\max}}{T_f} \qquad \text{If } t_{video} + T_f \geq T$$

$$S_{overlap}\% = \frac{S_{overlap}}{S_{\max}} = \frac{1}{2}\frac{(t_{video} + T_f - T)^2}{T \cdot T_f} \qquad \text{If } t_{video} \geq T - T_f$$

$$S_{overlap}\% = 0 \qquad \text{If } t_{video} \leq T - T_f$$

$$S_{offset}\% = \frac{S_{offset}}{S_{\max}} = \frac{1}{2}\frac{T_r(T - t_{video})^2}{T \cdot T_f} \qquad \text{If } t_{video} \geq T - T_f$$

$$S_{offset}\% = \frac{S_{offset}}{S_{\max}} = \frac{1}{2}\frac{T_r}{T} \qquad \text{If } t_{video} \leq T - T_f$$

$S_{overlap}$ and $S_{offset}$ are loaded into the tables LUT1 101 and LUT2 102. If the video signal is encoded over N bits, the percentage value must be multiplied by $2^N$-1.

Figure 9:
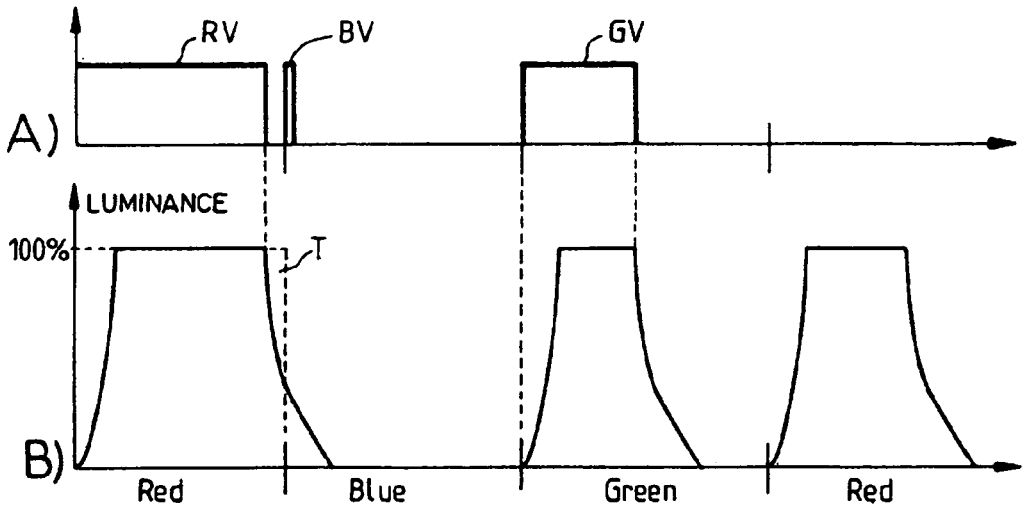
FIGS. 9 and 10 are luminance curves explaining the correction function applied in the present invention.
Figure 10:
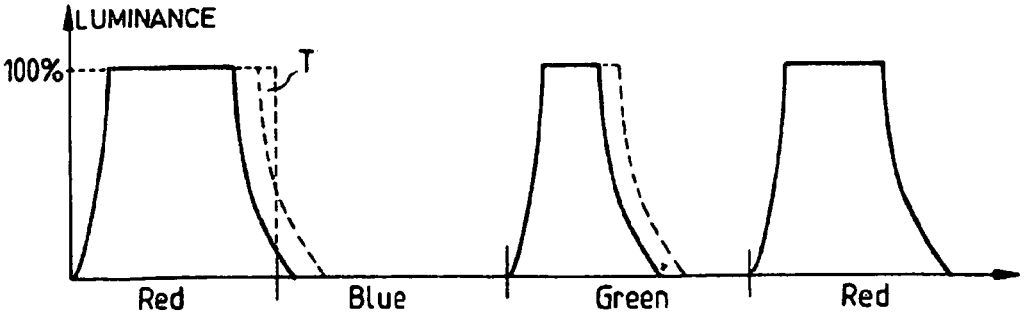

One way of carrying out the correction function, which may be implemented in the circuits 104 and 109 of FIG. 6, will now be described with reference to FIGS. 9 and 10. The upper part of FIG. 9 shows a theoretical video signal having a first pulse RV of duration equal to one subframe, a second, very short pulse BV during the next subframe and a third pulse GV of duration less than the duration of the third subframe. In this case, as regards luminance and as shown in part B in FIG. 9, there is an overlap value coming from the first subframe, namely the Red subframe in the embodiment shown, with the second or Blue subframe. Since the value of the blue colour is very low, an error is observed which does not allow the tint to be maintained. This is shown by the dotted line T, which crosses the falling edge of the Red luminance pulse. The same applies to the colour green. In this case, a correction function must be active in order to maintain the tint. This correction function reduces the value of the preceding colour (namely red in the embodiment shown) in such a way that the overlap value is equal to the value desired for the colour blue. This is shown in FIG. 10, in which it may be seen that the dotted line T crosses the falling edge when the blue value is approximately equal to zero. This correction function may be used with adders and multipliers, depending on the transfer below, taking as assumption the fact that the data is encoded over eight bits. When B-Overlap<0:

$$R_{out} = R_2 \times \left(1 - \frac{\text{Overlap} - B_1}{255}\right)$$

$$B_2 = 0$$

$$G_1 = G_{of} \times \left(1 - \frac{\text{Overlap} - B_1}{255}\right)$$

The same function can be applied to the other colours.

It is obvious to a person skilled in the art that the above examples have been given merely as an illustration.

The invention claimed is:

1. Method of improving the luminous efficiency of a sequential-colour matrix display, the display being driven using an addressing method of the pulse width modulation or PWM type, characterized, for each pixel of a subframe, by the following steps:

comparison of the pixel colour value of the preceding subframe with a reference value so as to provide an overlap value depending on the period of overlap with the current subframe;

if the pixel colour value of the current subframe less the overlap value gives a positive value, a time offset is to be added to the pixel colour value of the current subframe;

if the pixel colour value of the current subframe less the overlap value gives a negative value, the pixel colour value of the current subframe is forced to be zero.

2. Method according to claim 1, wherein, if the pixel colour value of the current subframe less the overlap value gives a negative value, the pixel colour value of the preceding subframe and the colour value of the next subframe are modified so as to maintain the original tint, while at the same time reducing the luminance.

3. Method according to claim 1, wherein the above steps apply in succession to each sequential colour of a frame.

4. Method according to claim 1, wherein the pixel colour value of a subframe depends on the width of the PWM-type addressing pulse.

5. Method according to claim 1, wherein the reference value depends on the response time of the material forming the display.

6. Method according to claim 5, wherein the reference value and the time offset are stored separately in two separate tables.

7. Method according to claim 5, wherein the reference value and the time offset are calculated from each other.

8. Method according to claim 1, wherein the time offset depends on the response time of the material forming the display and on the duration of the subframe.

* * * * *